US005669041A

United States Patent [19]

Thayer et al.

[11] Patent Number: 5,669,041

[45] Date of Patent: Sep. 16, 1997

[54] RETRACTING CLEANER WITH DEFINED PIVOT POINTS AND/OR SLIDING SEALS

[75] Inventors: Bruce E. Thayer; Dennis G. Gerbasi, both of Webster; Norman E. LaTour, Rochester, all of N.Y.

[73] Assignee: Xerox Corporation, Stamford, Conn.

[21] Appl. No.: 585,029

[22] Filed: Jan. 11, 1996

[51] Int. Cl.[6] ..... G03G 21/00

[52] U.S. Cl. ..... 399/102; 399/353

[58] Field of Search ..... 355/215, 296, 355/298, 299, 301, 302; 15/256.5; 399/102, 353, 354, 355

[56] References Cited

U.S. PATENT DOCUMENTS

| | | | |
|---|---|---|---|
| 4,230,406 | 10/1980 | Klett | 355/15 |
| 4,640,608 | 2/1987 | Higaya et al. | 355/299 |
| 4,669,864 | 6/1987 | Shoji et al. | 355/15 |
| 5,260,754 | 11/1993 | Yano et al. | 355/296 |
| 5,534,988 | 7/1996 | Gerbasi | 355/298 |

*Primary Examiner*—Joan H. Pendegrass
*Attorney, Agent, or Firm*—T. L. Fair

[57] ABSTRACT

An apparatus and method for retracting the cleaner from an imaging surface and preventing toner leakage. An apparatus and method that describes a DESB (i.e. dual electrostatic brush) cleaner in a multi-pass operation that not only has to clean the toner from the photoreceptor, but has to retract from the photoreceptor. The two brushes pivot about two defined pivot points in the cleaner housing during the retraction cycle to disengage from the photoreceptor during multi-pass operations. The first brush is pivoted up and the second brush is pivoted down. A further disclosure is the apparatus and method of using thin sliding and flexible plastic seals for a dual ESB that has moving (e.g. camming in and out) housings. The seals prevent leakage of the toner particles from the cleaner housing.

18 Claims, 6 Drawing Sheets

RETRACTING CLEANER WITH DEFINED PIVOT POINTS AND/OR SLIDING SEALS

BACKGROUND OF THE INVENTION

This invention relates generally to electrostatographic printers and copiers, and more particularly concerns a retracting cleaner with pivoting and/or sliding seals.

The multi-pass image on image color xerographic process includes four toner colors, cyano magenta, yellow and black. These four colors are developed onto the photoreceptor belt through four cycles of the photoreceptor. During this time toner layers are built up to create a full color image which is then transferred to a sheet of paper. As the color layers are being developed all subsystems which could disturb the image must be retracted from photoreceptor contact. These subsystems include the dual electrostatic brush cleaner and the spots blade. Due to motion quality concerns effecting color registration, the photoreceptor backers for the cleaner brushes cannot be retracted to withdraw the photoreceptor belt from the cleaner. Instead, the cleaner must be withdrawn from the photoreceptor. Additionally the retraction and engagement must be accomplished in the short time between documents. And, because the size of the interdocument region is small relative to the spacing between the two brushes, the brushes must be retracted and engaged independently. A cleaner with many independently moving parts can be very difficult to seal.

The following disclosures may be relevant to various aspects of the present invention and may be briefly summarized as follows:

U.S. Pat. No. 5,260,754 to Yano et al. discloses a cleaning device incorporated in an image forming apparatus for removing a toner remaining on a photoconductive drum by a fur brush and collecting the removed toner by a collecting roller. The cleaning device selectively moves the fur brush into and out of contact with both of the photoconductive drum and collecting roller.

U.S. Pat. No. 4,669,864 to Shoji et al. discloses an image forming apparatus having a cleaning device arranged on the outer periphery of an image retainer, and bringing into and out of abutment against the image retainer, wherein the cleaning device comprises a first cleaning member and a second cleaning member arranged downstream of the first cleaning member in the moving direction of the surface of the image retainer. A cleaning operation of the second cleaning member against the image retainer is conducted according to a time at which the cleaning operation of the first cleaning member against the image retainer is conducted.

U.S. Pat. No. 4,230,406 to Klett discloses an apparatus which cleans particles from a photoconductive member arranged to advance along a predetermined path. When the photoconductive member is stationary, the particle cleaner and photoconductive member are spaced from one another. The photoconductive member is deflected into engagement with the particle cleaner in response to the photoconductive member advancing along the pre-determined path. In this manner, the particle cleaner removes residual particles from the photoconductive member during the movement thereof along the pre-determined path.

SUMMARY OF INVENTION

Briefly stated, and in accordance with one aspect of the present invention, there is provided an apparatus having a cleaner subsystem for removing particles from an imaging surface, comprising: means for cleaning particles from the surface, the cleaning means having movement between at least two positions including a first position and a second position; means for detoning particles from the cleaning means; an internal cavity in the cleaner subsystem for collecting the particles being removed from the surface; means for containing the particles in the internal cavity to prevent the particles from escaping therefrom; and means for transporting the particles collected in the internal cavity to a waste container.

Pursuant to another aspect of the present invention, there is provided a method for removing the particles in a multi-pass printing machine from the imaging surface using a cleaning device in a cleaner subsystem, the cleaning device having two brushes, comprising: engaging the cleaning device with the surface; cleaning the particles from the surface; retracting the cleaning device from the surface; detoning the particles from the cleaning device; collecting the particles being removed from the surface in an internal cavity in the cleaner subsystem; preventing the particles from escaping from the internal cavity; and transporting the particles collected in the internal cavity to a waste container.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 6:
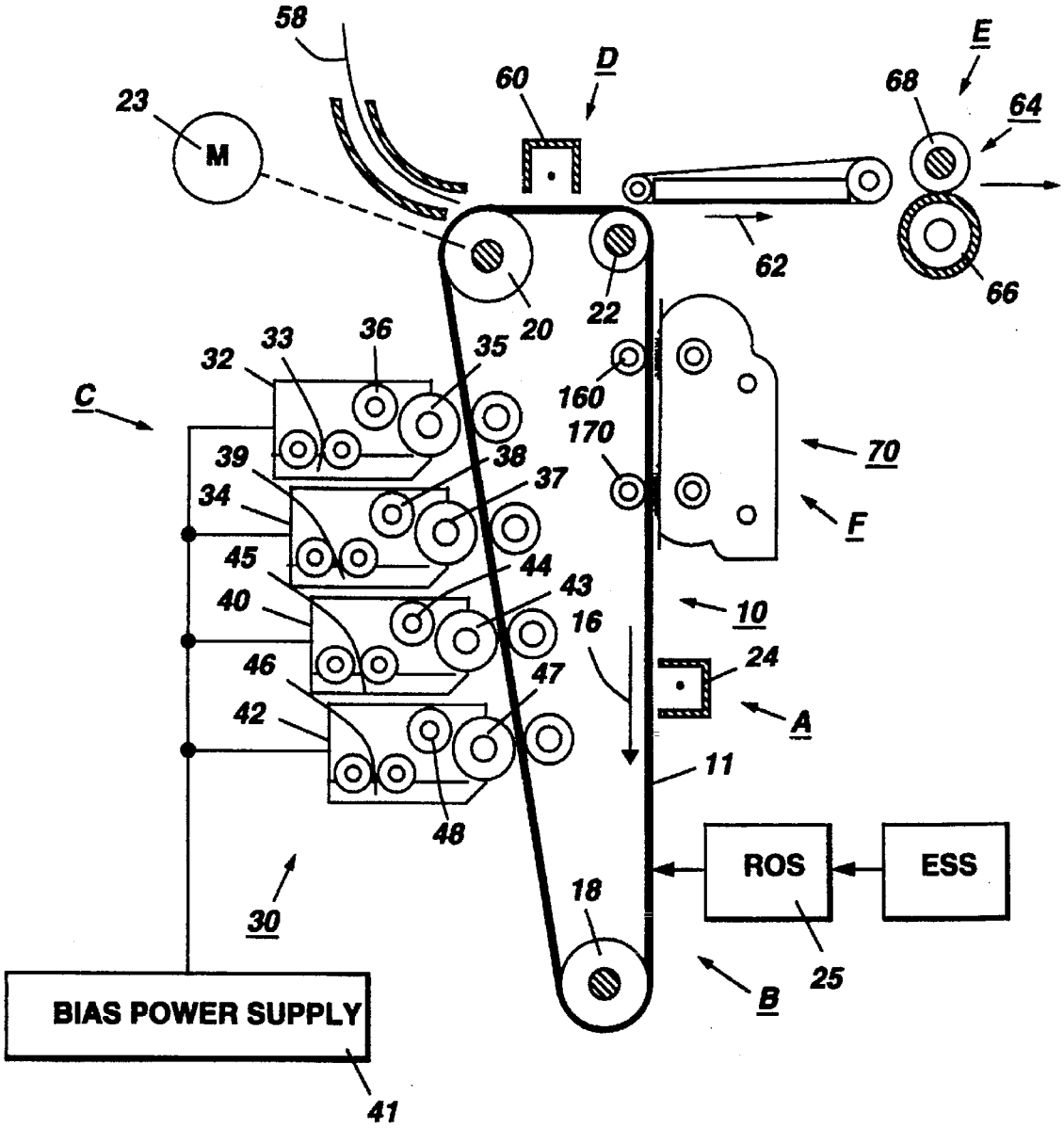
FIG. 6 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 6 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement pass charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 6, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. The cleaning system is supported under the photoreceptive belt by two backers 160 and 170.

The multi-pass (e.g. four passes for four colors) single transfer process requires that the cleaner function be disabled, while different color toners are sequentially built up on the photoreceptor. Mid-volume family (i.e. MVF) machine applications normally require a dual electrostatic brush (DESB) cleaner to meet motion quality (MQ) goals that a retracting blade cleaner, for example, cannot meet.

However, the retraction method of a dual electrostatic brush cleaner is complicated in comparison with the retracting method of a single cleaner (e.g. blade, brush). Especially, when more than one cleaner must be retracted in the interdocument zone, and the interdocument zone (i.e. ID zone or non-imaging region) can only accommodate one cleaner (e.g. a brush (due to it's diameter)) at a time.

Figure 1:
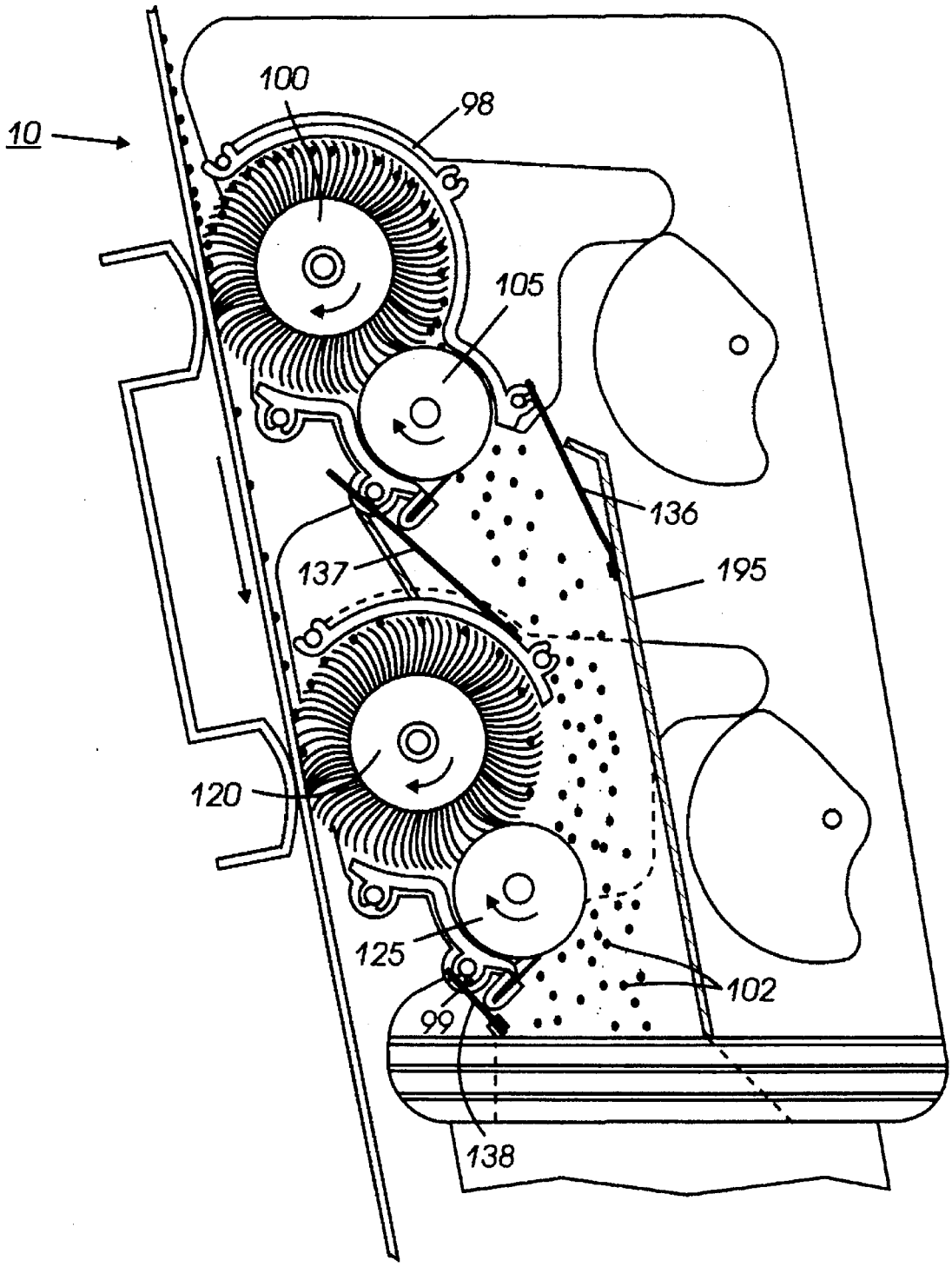
FIG. 1 is an elevational schematic of an embodiment of the present invention showing three side seals.

Reference is now made to FIG. 1, which shows an elevational schematic view of an embodiment of the present invention showing three side seals. In the cleaning apparatus shown, both brushes 100, 120 are retractable by pivoting about the center axis of the detoning rolls 105, 125. The plastic film side seals 136, 137, and 138 are used to contain toner particles 102 in the cleaner during a multi-pass color process. These side seals 136, 137, and 138 are capable of sealing between components which have large variations in the gap between them as they are retracted, but still operate with very small drag forces. These side seals 136, 137 and 138 are simple to fabricate, low cost, easy to assemble (see FIGS. 3A–3C) and include two variations. The first seal variation type is attached to one surface and spans a gap to a second surface where the seal is attached and slides with pressure contact. An example of this first variation type seal is shown by the flexible (e.g. Mylar) slidable seal 137 used between the housings 98, 99. The second variation type of seal is attached to rotating elements between two abutting seal surfaces. An example of these attached seals are shown by the side seals 136 and 138. These side seals 136, 138 are attached on one end to the retractable brush housing 98, 99 and attached on the other end to the housing wall 195.

Figure 2A:
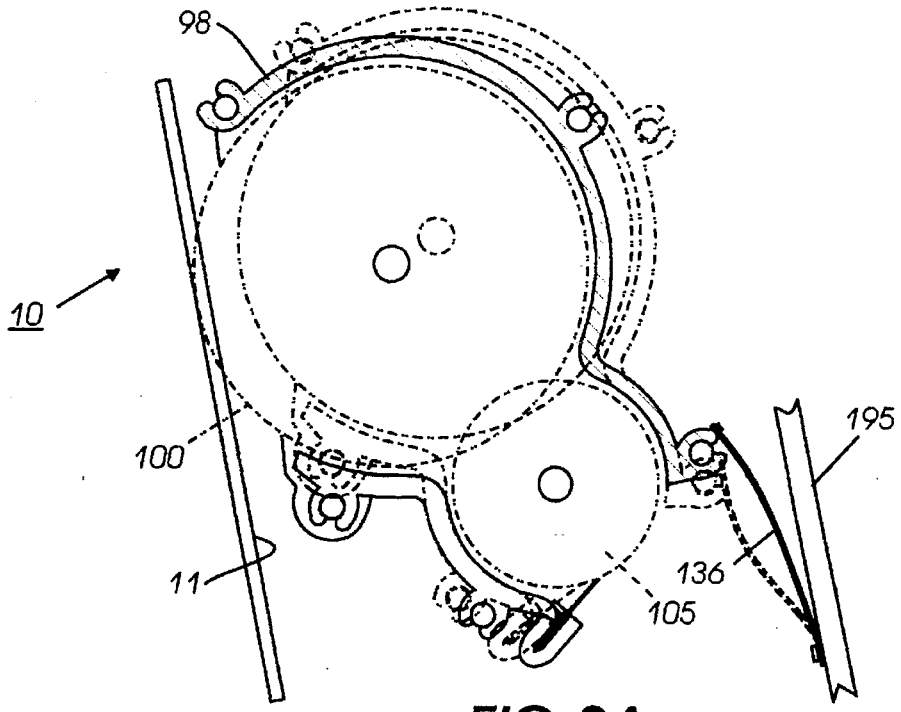
FIGS. 2A and 2B show the motion of two of the side seals attached to a brush housing on one end, and to the cleaner housing on another end.
Figure 2B:
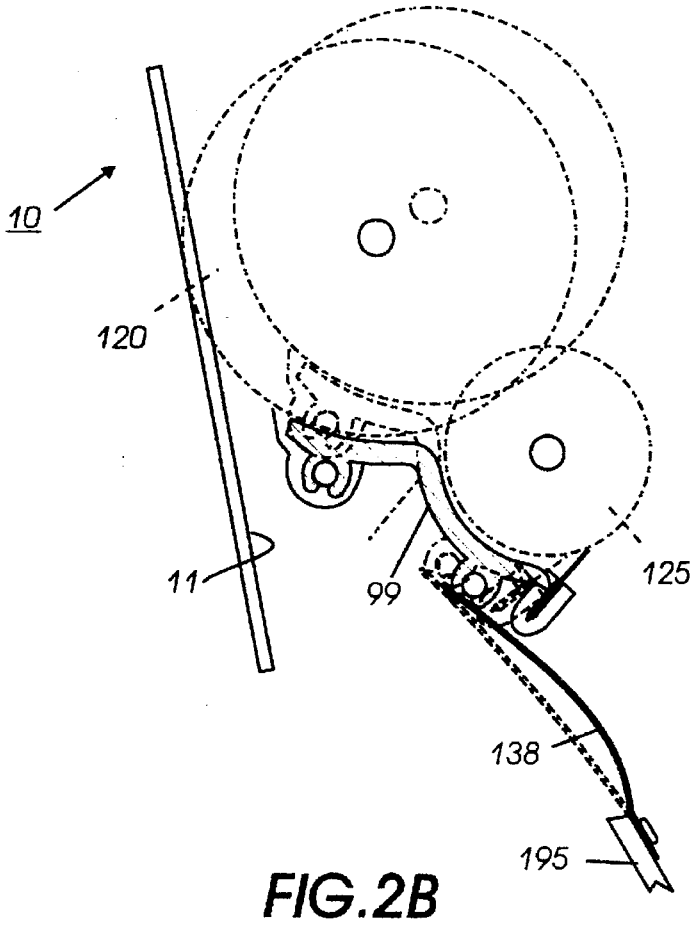

Reference is now made to FIGS. 2A and 2B, which shows the motion of the side seals 136, 138 which are attached on both ends of the seals 136, 138. (Side seal 137 is attached on only one end to the brush housing 99 and slidably in contact, on the other end, with the other brush housing 98.) The cleaner consists of two independently rotating brush housings 98, 99 within a larger cleaner housing 195 that contains the residual toner, cleaned from the surface 11, and guides it to a lower waste toner bottle (not shown). Side seals 136, 137 (see FIG. 1), and 138 extend the full length of the cleaner housing 195 inboard to outboard. The end seals labeled 200, 210, 220, and 230 (shown in FIGS. 4A and 4B) are located on each end of the cleaner housing 195 and prevent toner particles from escaping around the ends of the brush housings 98, 99. These end seals 200, 210, 220, 230 (see FIGS. 4A and 4B) to the endplates are a different type of seal than the three side seals 136, 137 (see FIG. 1), and 138. The two types of seals (i.e. side seals and end seals) are discussed separately below with seals 136, 137 (see FIG. 1), and 138 being referred to as side seals, and seals 200, 220, and 230 (see FIGS. 4A and 4B) being referred to as end seals.

Continuing reference is made to FIGS. 2A and 2B which shows two 136, 138 of the three side seals of the present invention. These side seals 136, 138 consist of long flexible plastic film strips which are attached on one long side to a brush housing 98, 99 and on the other long side is attached (or slides) against the other brush housing 98, 99 or the cleaner housing 195. If both sides of a side seal 136, 138 are attached to a housing, enough slack must be present in the side seals 136, 138 to prevent the seals from being pulled away from the housings 98, 99, 195. These seals 136, 138 allow rotation of the brush housings 98, 99 without opening of the toner containment area. The seals 136, 138 operate by flexing to allow motion of the brush housing 98, 99 but, without extra seal length to cause toner accumulation in the folds of slack seals. The seals also operate by flexing to allow motion of the brush housing 98, 99 without sliding of seals 136, 138 across surfaces which could result in wear of the seals, such as with foam seals. The seals 136, 138 are shown in solid lines when engaged with the brush housings 98, 99 and are shown in dotted lines when retracted from the brush housings 98, 99. Another advantage of sliding/attached seals over foam seals is that the former seals 136, 138 create very little resistance to the rotation of the brush housings 98, 99. Earlier attempts to seal these areas with foam resulted in very high forces to retract the brush housings because of the pressure required to compress the foam seals. A further problem with foam seals is that they are generally useful only for very small variations in the sealing gap. In the case of a rotating housing, the gap to be sealed can be varied over a relatively large range. Foam seals used in this application must be thick enough to fill the largest gap and then must be compressed to the size of the smallest gap. The flexible film seal 136, 138 has another advantage over the foam seal in that, unlike foam, the flexible film does not take a set over time.

Figure 3A:
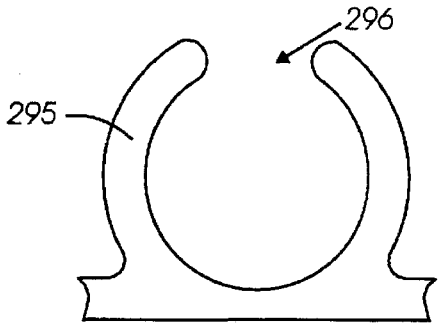
FIGS. 3A, 3B and 3C show a sequenced quick method for assembling flexible film seals to a housing.
Figure 3B:
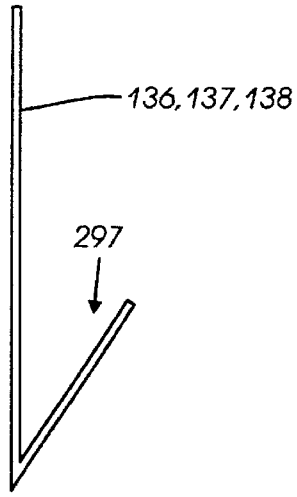
Figure 3C:
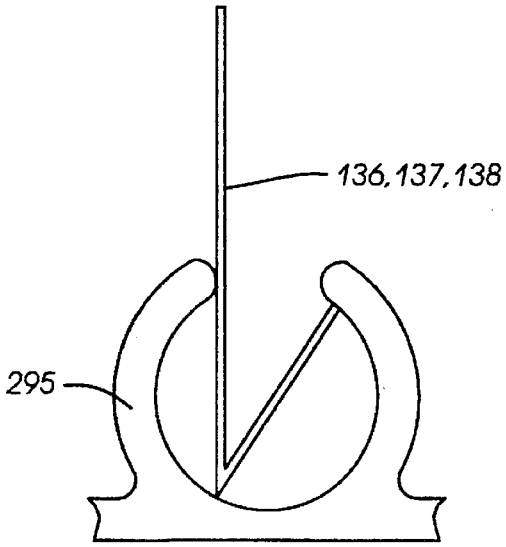

Reference is now made to FIGS. 3A, 3B, and 3C which shows a sequenced quick method of assembling the flexible film seals 136, 137, 138 to a housing. Assembly of the flexible film seals 136,137,138 is accomplished by first attaching a seal to the brush housing. This can be done by taping the seal to the housing, or inserting the seal into a slot 296 in the housing. In the present invention, the housing of the cleaner is an extruded aluminum shape with extruded screw bosses 295 (see FIG. 3A) for attaching the brush housing endplates. The flexible film seals 136, 137,138 are attached to the brush housings by inserting the film seals into these slots. The seal is folded to create a lip 297, as shown in FIG. 5B, which when inserted into the extruded slot 295 holds the film seal 136, 137, or 138 in place (see FIG. 3C). The brush housing is then assembled into the cleaner housing. The last step is to attach the other end of the flexible film seal to the cleaner housing. For the top seal, 136, a long extension was added to the seal to allow attachment to be made at the bottom of the cleaner housing, just above the waste bottle (not shown) entrance. Prior to insertion of the waste bottle (not shown), this area is readily accessible. It is thus, easy to secure the bottom of the seal 136 to the inside edge of the cleaner housing. The bottom seal, 138, can be attached to the housing at the extruded screw boss 295 and secured to the cleaner housing on the other side of the waste bottle entrance.

Referring again to FIG. 1, the middle seal 137 between the two brush housings, 98, 99 is mounted to the second brush housing 99 using the snap assembly (see FIGS. 3A, 3B and 3C) into an extruded screw boss as used for seals 136 and 138. The other end of the film seal 137 is not attached to the first brush housing 98. Instead the seal 137 is pressed against a smooth radial portion of the first brush housing 98 and allowed to slide on this surface as the two brush housings 98, 99 are rotated relative to each other. In order to seal this sliding seal 137 well, it is necessary that sliding seal 137 be stiffer (i.e. lower flexibility) than the other side seals 136 and 138. This is accomplished by using thicker plastic film (e.g. Mylar) for side sliding seal 137. The seal 137 between the two brush housings 98, 99 is able to slide on the first brush housing 98 rather than being attached so that the two brush housings 98, 99 could be easily assembled into the cleaner housing 195. The assembly process (see FIGS. 3A–3C) involves attaching the seal 137 to the second brush housing 99, and then installing the first brush housing 98. During installation of the second brush housing 99 the seal, 137, is flexed into position against the first brush housing 98 and actions are required by the assembler to position or attach the seal 137.

Figure 4A:
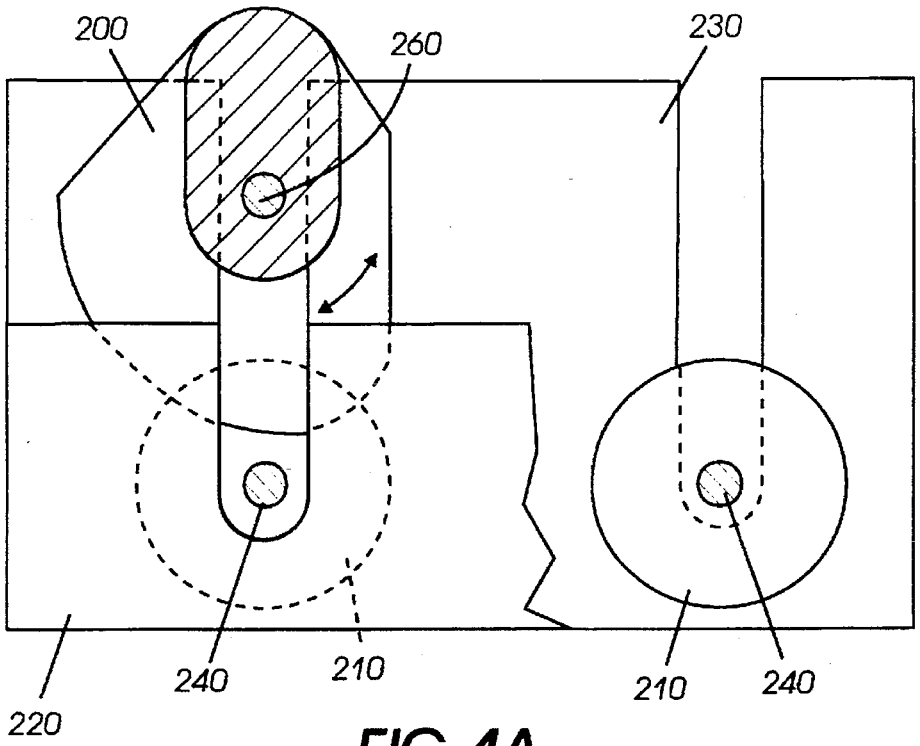
FIGS. 4A and 4B are a schematic view of the end seals configuration of the present invention shown in FIG. 1.
Figure 4B:
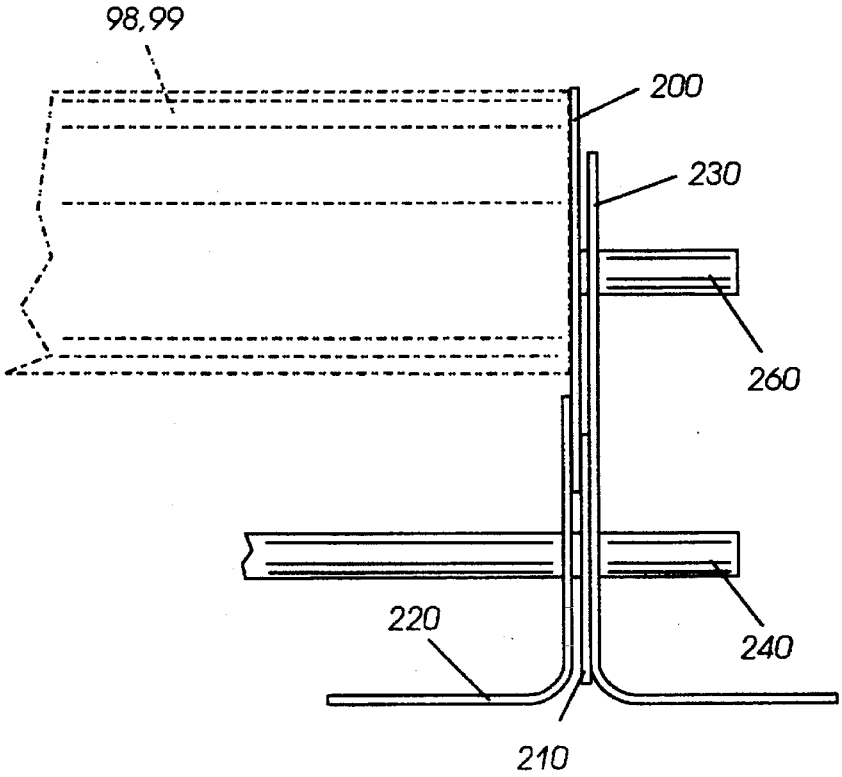

Reference is now made to FIGS. 4A and 4B, which show schematic view of the end seals configuration of the present invention embodiment shown in FIG. 1. The end seals, 200, 210, 220 and 230 are required to seal the ends of the brush housings 98, 99 (see FIG. 1) to the cleaner housing 195. In this case, the two housings 98, 99 (see FIG. 1) are moving relative to each other but only the retraction cam shafts 240 and the detoning roll drive shafts 260 (e.g. also the brush housing pivots) are required to pass through the end seals 200,210,220,230. The seals keep the residual toner contained so that it can fall into a waste bottle and prevent toner from contaminating the brush drives. In the present invention cleaner, mounting a stiff film seal to each of the brush housing endplates prevents toner contamination of the brush drives. Another stiff circular film seal 210 was attached to each of the two cam shafts 240 and a pair of stiff film seals 220, 230 were attached to the back cleaner housing wall. The pair of seals attached to the cleaner housing wall have slots to allow assembly of the seals and cam shafts 240 and drive shafts 260. The housing wall has slots to allow assembly of the seals and cam shafts 240 and drive shafts 260. The inner seal 220, mounted on the cleaner housing wall which faced the brush housings, is also made shorter than the outer seal 230, which faced the cleaner housing endplate, to allow rotation of the brush housings. The seals operate by sandwiching the cam and the brush housing seals 200 between the pair of cleaner housing seals 220, 230. Each of the brush housing seals 200 and cam seals 210 slides against the cleaner housing seals 220, 230 to prevent leakage of toner. The brush housing seals 200 and cam seals 210 are designed to overlap so that a good seal is maintained and so that the seals cannot bind by hitting edges during retraction, but smoothly slide past each other. Assembly of the seals is accomplished by first inserting the cam shaft seal 210 which is facilitated by the difference in height of the two cleaner housing seals 220, 230. The brush housing seals 200 are then assembled in a similar manner. The plastic film used in these seals is the same polyester material used in the side seals, but much thicker material is used to provide the stiffness required. Seals of this type lend themselves to cleaner and other subsystem applications requiring the sealing of retracting, rotating or translating components.

Figure 5:
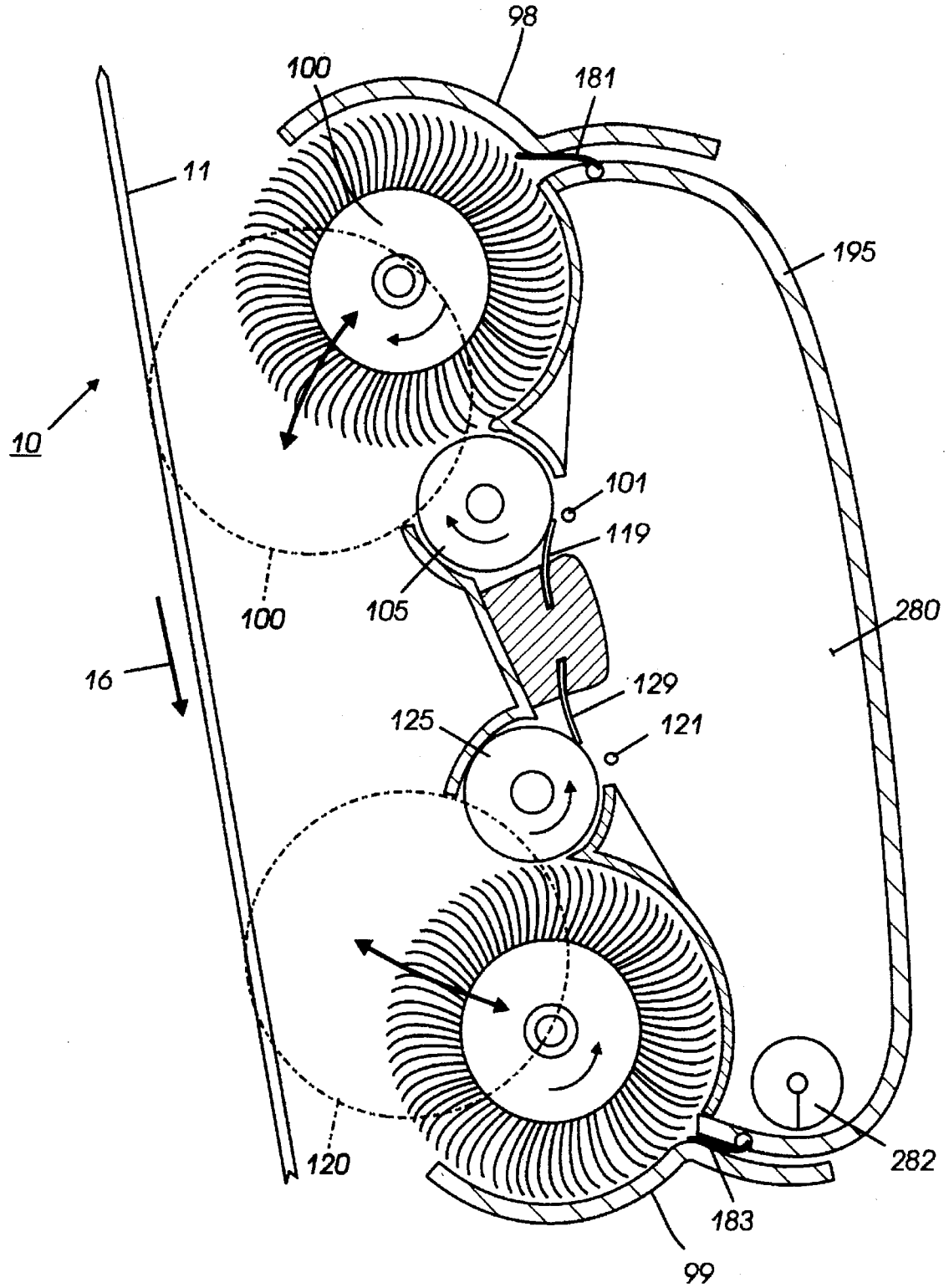
FIG. 5 is an elevational schematic view of the preferred embodiment of the present invention utilizing pivot points that enable retraction of one brush up while retracting another brush down.

Reference is now made to FIG. 5, which shows an elevational schematic view of the preferred embodiment of the present invention utilizing pivot points that enable retraction of one brush up while retracting another brush down. The DESB (dual electrostatic brush) cleaner in a multi-pass operation must be able to clean toner from the photoreceptor (i.e. toner that was not transferred from the photoreceptor) and retract the cleaner(s) from the photoreceptor (i.e. the cleaners are out of contact with the photoreceptor) until after the image is transferred. If the cleaning brushes 100, 120 are not retracted, the brushes 100, 120 will remove the untransferred image. During the normal operating cycle, no unacceptable photoreceptor motion disturbances or toner emissions may be caused by the cleaner. In the present invention, a miniaturized dual electrostatic brush (MDESB) cleaner with detoning rolls 105, 125 for multipass image on image color products is used due to superior performance and reduced cost over other conventional cleaners. Both electrostatic brushes 100, 120 must be removed from the photoreceptor, independently, in the small interdocument gap (e.g. about 50 mm, not shown). In the present invention, the brushes 100, 120 pivot around two defined pivot points 101,121 in the cleaner housing 195 during the retraction cycle to disengage the brushes 100, 120 from the photoreceptor 10 during multipass operations.

With continued reference to FIG. 5, the present invention discloses pivoting the first brush 100 in an opposite direction than that of the second brush 120. (e.g. In the figure, the first brush is pivoted up and the second brush 120 is pivoted down.) The pivoting of the brushes in this manner is the preferred embodiment of the present invention. Several different methods of removing the brushes 100, 120 from the photoreceptor were investigated including moving the entire cleaner, retracting the photoreceptor backers, pivoting each cleaner unit, and having a moving door between the brushes and the photoreceptor. Of these methods, pivoting each brush around a fixed pivot point 101,121 was determined to be the preferred embodiment because it enabled simple less complicated drives for the cleaner, lower toner emissions, lower motion quality risks, and better sealing.

Continued reference is made to FIG. 5, which shows that by retracting the second brush 120 down, the seal 137 (shown in FIG. 1) between the first brush 100 and the second brush 120 can be eliminated. The internal cavity 280 of the cleaner has a space for the retracted brushes 100, 120 to rest without contacting the detoning rolls 105, 125 so that brush set is prevented. The phantom lines of the brushes 100, 120 show the brushes 100, 120 when they are engaged for cleaning of the photoreceptor 10. The toner particles electrostatically removed from the brushes 100, 120 by the detoning rolls 105, 125 are removed from the detoning rolls by scraper blades 119, 129. The scraper blades guide the toner particles into the internal cavity 280. An auger 282 transports the toner particles away from the cleaning subsystem. Toner leakage is prevented from channel openings using seals 181,183 about the internal cavity 280.

In recapitulation, the present invention describes a DESB (i.e. dual electrostatic brush) cleaner in a multi-pass operation that not only cleans the toner from the photoreceptor, but retracts the dual cleaner from the photoreceptor. The two brushes, each partially enclosed in a separate brush housing pivot around two defined pivot points in the cleaner housing during the retraction cycle to disengage from the photoreceptor during multi-pass operations. This invention discloses pivoting the first brush up and second brush down. An advantage of this invention is that it reduces the space needed for the cleaning system, by allowing the two brush housings to be moved closer to each other.

Another embodiment of the present invention discloses the concept of using thin sliding and flexible plastic seals for a dual ESB that has moving (e.g. camming in and out) housings. The purpose of the seals is to contain toner in the cleaner housing.

It is, therefore, apparent that there has been provided in accordance with the present invention, a retracting cleaner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus having a cleaner subsystem for removing articles from an imaging surface, comprising:

means for cleaning particles from the surface said cleaning means movement between at least two positions including a first position and a second position;

means for detoning particles from said cleaning means;

an internal cavity in the cleaner subsystem for collecting the particles being removed from the surface;

means for containing the particles in the internal cavity to prevent the particles from escaping therefrom, said containing means comprises means for pivoting said cleaning means between the first position and the second position the first position having said cleaning means in contact with the surface and the second position having said cleaning means out of contact with the surface said cleaning means comprising a first brush and a second brush capable of between the first position and the second position about said pivoting means, said first brush being located upstream, from said second brush, in a direction of motion of the surface said pivoting means comprises: a first pivot point enabling movement of the first brush between the first position and the second position; and a second pivot point enabling movement of the second brush between a first position and a second position, opposite the direction of movement of first brush; and means for transporting the articles collected in said internal cavity to a waste container.

2. An apparatus as recited in claim 1, wherein said first brush being pivoted, about said first pivot point, from the first position to the second position.

3. An apparatus as recited in claim 2, wherein said second brush being pivoted, about said second pivot point, from the first position to the second position.

4. An apparatus as recited in claim 3, wherein said first brush being pivoted, about said first pivot point, from the second position and returning to the first position.

5. An apparatus as recited in claim 4, wherein said second brush being pivoted about said second pivot point, from the second position and returning to the first position.

6. An apparatus having a cleaner subsystem for removing particles from an imaging surface, comprising:

means for cleaning particles from the surface, said cleaning means having movement between at least two positions including a first position and a second position;

means for detoning particles from said cleaning means;

an internal cavity in the cleaner subsystem for collecting the particles being removed from the surface;

means for containing the particles in the internal cavity to prevent the particles from escaping therefrom, said containing means comprises: at least two members having a gap therebetween, said members including a first member and a second member; film seals including a first film seal and a second film seal, for containing the particles in the internal cavity, said film seals being coupled to said members; and means for transporting the particles collected in said internal cavity to a waste container.

7. An apparatus as recited in claim 6, wherein said members are movable.

8. An apparatus as recited in claim 7, wherein said film seals are slidable between said first member and said second member.

9. An apparatus as recited in claim 8, wherein said cleaning means comprises a first brush and a second brush, said first brush being located upstream, from said second brush in a direction of motion of the surface.

10. An apparatus as recited in claim 9, wherein said first member includes said first brush and said second member includes a housing defining an open ended chamber about said cleaning means.

11. An apparatus as recited in claim 9, wherein said first member comprises said first brush and said second member comprises said second brush.

12. An apparatus as recited in claim 9, wherein said first member comprises said second brush and said second member comprises a waste bottle, having an entrance through which particles enter.

13. An apparatus as recited in claim 6, wherein said first film seal having two ends opposite one another, attaches one end to said cleaning means having a first surface and spans a gap attaching the other end to a second surface, said first film seal being attached slidable with pressure contact thereto.

14. An apparatus as recited in claim 13, wherein said second film seal is attached to rotating elements between two surfaces.

15. An apparatus as recited in claim 14, wherein said first film seal comprises a side seal.

16. An apparatus as recited in claim 15, wherein said second film seal comprises an end seal.

17. A method for removing the particles in a multipass printing machine from the imaging surface using a cleaning device in a cleaner subsystem, the cleaning device having two brushes, comprising:

engaging the cleaning device with the surface;

cleaning the particles from the surface;

retracting the cleaning device from the surface comprising pivoting the first of the brushes about a first pivot point enabling movement between a first position and a second position and pivoting the second of the brushes about a second pivot point enabling movement between a first position and a second position, opposite the direction of movement of the first of the brushes;

detoning the particles from the cleaning device;

collecting the particles being removed from the surface in an internal cavity in the cleaner subsystem;

preventing the particles from escaping from the internal cavity; and transporting the particles collected in the internal cavity to a waste container.

18. A method for removing the particles in a multipass printing machine from the imaging surface using a cleaning device in a cleaner subsystem, the cleaning device having two brushes, comprising:

engaging the cleaning device with the surface;

cleaning the particles from the surface;

retracting the cleaning device from the surface;

detoning the particles from the cleaning device;

collecting the particles being removed from the surface in an internal cavity in the cleaner subsystem;

preventing the articles from escaping from the internal cavity, the step of preventing the particles from escaping comprises the step of sliding seals preventing leakage from the internal cavity; and transporting the particles collected in the internal cavity to a waste container.

* * * * *